US008863528B2

(12) United States Patent
Shi et al.

(10) Patent No.: US 8,863,528 B2
(45) Date of Patent: Oct. 21, 2014

(54) CERAMIC COMBUSTOR CAN FOR A GAS TURBINE ENGINE

(75) Inventors: Jun Shi, Glastonbury, CT (US); David J. Bombara, New Hartford, CT (US); Jason Lawrence, East Hartford, CT (US); Richard S. Tuthill, Bolton, CT (US); Jeffrey D. Melman, Simsbury, CT (US)

(73) Assignee: United Technologies Corporation, Hartford, CT (US)

( * ) Notice: Subject to any disclaimer, the term of this patent is extended or adjusted under 35 U.S.C. 154(b) by 2240 days.

(21) Appl. No.: 11/494,083

(22) Filed: Jul. 27, 2006

(65) Prior Publication Data

US 2014/0190167 A1 Jul. 10, 2014

(51) Int. Cl.
*F02C 7/20* (2006.01)
*F23R 3/60* (2006.01)

(52) U.S. Cl.
USPC ..... 60/753; 60/800

(58) Field of Classification Search
USPC ..... 60/752, 753, 796, 800; 431/343, 353
See application file for complete search history.

(56) References Cited

U.S. PATENT DOCUMENTS

| | | | | |
|---|---|---|---|---|
| 3,911,672 | A * | 10/1975 | Irwin | 60/796 |
| 4,363,208 | A | 12/1982 | Hoffman et al. | |
| 4,573,320 | A | 3/1986 | Kralick | |
| 5,353,586 | A * | 10/1994 | Taylor et al. | 60/39.37 |
| 5,392,596 | A | 2/1995 | Holsapple et al. | |
| 5,457,954 | A * | 10/1995 | Boyd et al. | 60/800 |
| 6,047,539 | A * | 4/2000 | Farmer | 60/775 |
| 6,182,451 | B1 * | 2/2001 | Hadder | 60/732 |
| 6,397,603 | B1 * | 6/2002 | Edmondson et al. | 60/753 |
| 6,571,560 | B2 * | 6/2003 | Tatsumi et al. | 60/753 |
| 6,708,495 | B2 * | 3/2004 | Calvez et al. | 60/753 |
| 7,237,389 | B2 * | 7/2007 | Ryan et al. | 60/800 |
| 2005/0039458 | A1 * | 2/2005 | Leen et al. | 60/748 |
| 2005/0086945 | A1 * | 4/2005 | Tiemann | 60/800 |
| 2006/0101827 | A1 * | 5/2006 | Ryan et al. | 60/796 |

FOREIGN PATENT DOCUMENTS

| | | |
|---|---|---|
| EP | 1148300 | 10/2001 |
| EP | 1152191 | 11/2001 |
| EP | 1719949 | 11/2006 |
| JP | 9079578 | 3/1997 |

OTHER PUBLICATIONS

European Search Report dated Sep. 16, 2011. EP App. No. 07252052. 1-1266 / 1882885.

* cited by examiner

*Primary Examiner* — Andrew Nguyen
(74) *Attorney, Agent, or Firm* — Carlson, Gaskey & Olds, P.C.

(57) ABSTRACT

A combustor assembly having a support assembly between a metal support assembly and a ceramic combustor can section that accommodates a thermal expansion difference therebetween. An air fuel mixer and an igniter are mounted to the support assembly secured to the ceramic combustion can which receives the ignition products of the ignited fuel and air mixture.

13 Claims, 24 Drawing Sheets

CERAMIC COMBUSTOR CAN FOR A GAS TURBINE ENGINE

This invention was made with government support under Contract No. N00014-03-C-0477 awarded by the Office of Naval Research. The government therefore has certain rights in this invention.

BACKGROUND OF THE INVENTION

This invention relates to gas turbine engines and, more particularly, to a combustor assembly having a unique attachment between a ceramic combustor can and a metal fuel-air mixture section.

Conventional gas turbine engines, such as those used in aircraft, utilize a combustor to ignite a mixture of fuel and compressed air. Utilizing significant compressed air may further reduce the air available for combustor liner cooling and result in pressure loss during the cooling of the combustor liner. Such a lean mixture reduces the amount of air available to cool the combustor and increases the combustor temperature. Common by-products of fuel combustion are NOx and CO. To reduce NOx produced in the combustor, it is desirable to reduce the flame temperature. This requires a high percentage of compressed air to be mixed with the fuel to produce a lean fuel air mixture. For combustors made entirely of metal, the increase in temperature may exceed a desirable operating temperature of the metal.

To lower the cooling air requirement and the pressure loss, high temperature ceramic materials have been proposed for combustor liners. Disadvantageously, the coefficient of thermal expansion (CTE) of ceramics is typically much lower than that of metals, which may lead to thermal stress between parts made of ceramic and parts made of metal alloys. Furthermore, the difference in coefficients of the thermal expansion between ceramic and metal may render typical joining methods, such as welding or bonding, ineffective.

Accordingly, there is a need for a combustor assembly that provides and maintains a tight fit between a ceramic part and a metal part over a relatively wide temperature range.

SUMMARY OF THE INVENTION

The present invention includes a combustor assembly having a support assembly between a metal support assembly and a ceramic combustor can section that accommodates a thermal expansion difference therebetween. An air fuel mixer and an igniter are mounted to the support assembly such that the ceramic combustor can receive the ignition products of the ignited fuel and air mixture.

One support assembly includes a metal front support ring which interfaces with the ceramic combustor can. An inclined contact interface permits the front support ring to slide relative the ceramic combustor can upon thermal excursion. A relatively thin wall thickness front support ring in combination with slots truncate hoop stress. A multitude of fasteners provide definitive circumferential and axial constraints between the front support ring and the ceramic combustor can. Fastener openings through the front support ring are at least partially elliptical or slot-like to facilitate relative sliding between the front support ring and the ceramic combustor can during thermal excursion.

Another support assembly includes a heat shield actively cooled by impingement cooling air on the outer diameter thereof. As the front support ring now operates in a relatively lower temperature regime since it is protected by the heat shield, the front support ring is able to withstand higher stresses and deform elastically to ensure the safe operation of the ceramic combustor can and the gas turbine engine.

Another support assembly includes a ceramic combustor can manufactured as a relatively straight cylinder. An axially extended front support ring extends downstream to also support the combustor igniter and includes a reduced diameter stepped interface over which the ceramic combustor can is fitted.

Another support assembly includes a ceramic combustor can with an outwardly flared outer diameter interface to receive an extended heat shield and an attached front support ring. The extended heat shield is welded or otherwise affixed to the front support ring to form a radial spring interface with the outwardly flared outer diameter interface to readily accommodate thermal expansion.

Another support assembly includes a ceramic combustor can with a reduced diameter attachment segment to provide a bottle-shaped ceramic combustor can. The ceramic combustor can is sandwiched between an outer-segmented ring and an inner full ring. The segmentation and fasteners per segment permit the outer segmented ring to follow the thermal growth of the ceramic combustor can without significant stress.

Another support assembly includes a multitude of springs formed of "U" shaped metal strips that receive a front lip of the ceramic combustor can between an inner support and an outer support plate. A fastener through each spring "pins" the ceramic combustor can axially and circumferentially, while the springs provide radial support.

Another support assembly confines thermal growth mismatch within a plane normal to a longitudinal axis of the ceramic combustor can.

Another support assembly includes a ceramic combustor can manufactured as a relatively straight cylinder with a frustro-conical attachment segment. The frustro-conical attachment segment facilitates sliding of the ceramic combustor can between an inner frustro-conical support and a segmented outer frustro-conical support.

The present invention therefore provides a combustor assembly that maintains a tight fit between a ceramic combustor can and a metal support assembly over a relatively wide temperature range.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
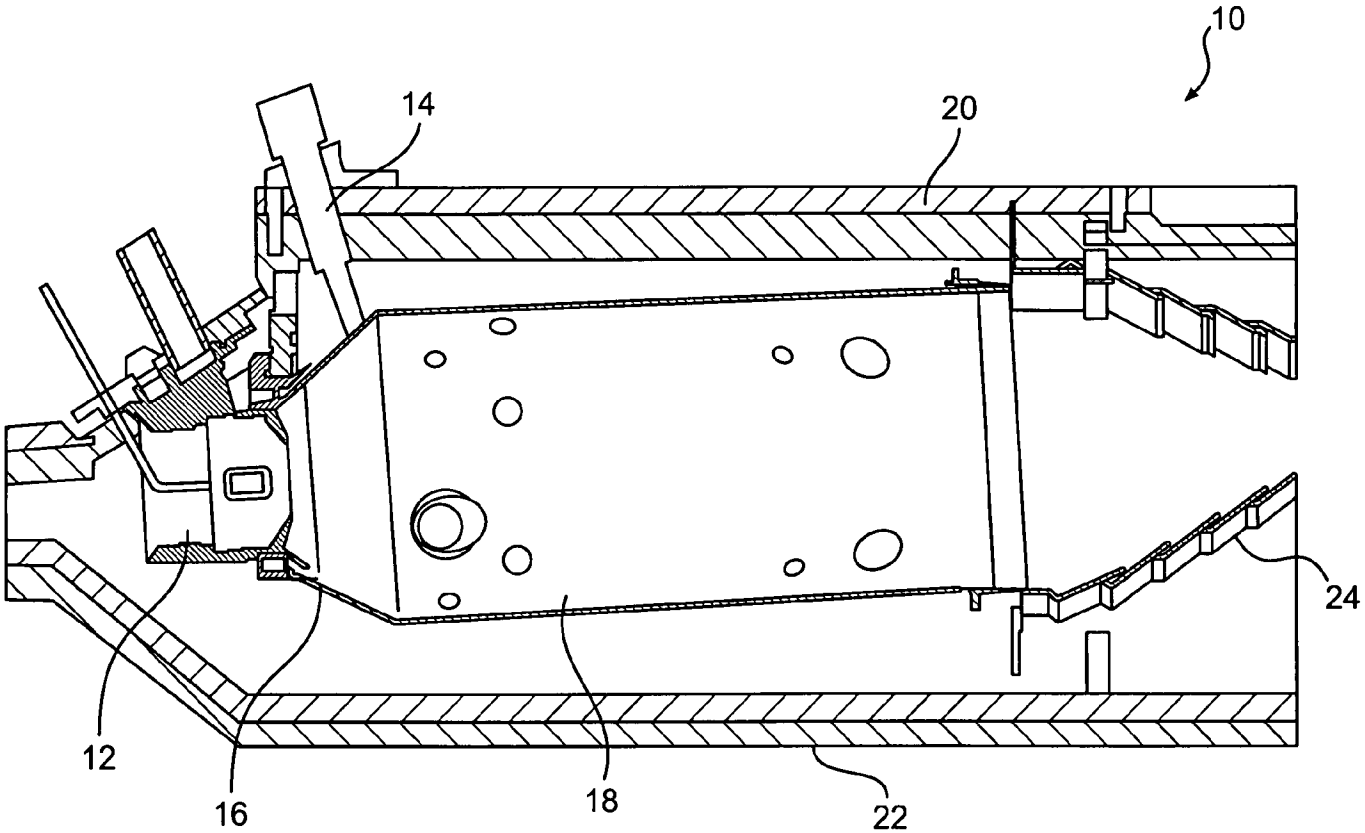
FIG. 1 is a longitudinal sectional view of a combustor section.

FIG. 1 illustrates selected portions of a combustor section 10 used, for example, in a gas turbine engine. The combustor section 10 includes an air fuel mixer 12 that supplies a mixture of air and fuel to be ignited by an igniter 14. The air fuel mixer 12 and the igniter 14 are mounted to a support assembly 16 preferably manufactured of metallic materials. The support assembly 16 is secured to a ceramic combustor can 18, which receives the ignition products of the ignited fuel and air mixture. The ceramic combustor can 18 is preferably mounted within a combustor outer casing 20 and inner casing 22. The ceramic combustor can 18 directs the ignition products through a transition duct 24 and into a turbine section (not shown) of a gas turbine engine. Combustion and dilution air is added downstream of the igniter to maintain a stable combustion process and an acceptable temperature profile at the turbine inlet. For further understanding of other aspects of the interface and associated components thereof, attention is directed to U.S. patent application Ser. No. 11/254,876 which is assigned to the assignee of the instant invention and which is hereby incorporated herein in its entirety.

A flame temperature distribution in the combustion section 10 is such that the front end near the igniter 14 has a relatively low temperature flame and the aft end near the ceramic can 18 and transition duct 24 has a relatively high temperature flame. Utilizing the support assembly 16 near the relatively cooler flame and the ceramic can 18 near the relatively hotter flame provides the benefit of reducing undesirable carbon monoxide emissions produced in previously known combustor assemblies. The ceramic material of the ceramic can 18 does not require as much cooling as a metal material. Since there is less cooling with the ceramic can 18, less carbon monoxide is produced compared to previously known combustor assemblies that utilize a metallic can. Further, the ceramic material of the ceramic can 18 is less dense than metal and therefore reduces the weight of the gas turbine engine within which the combustor section 10 is mounted. Furthermore, utilizing the relatively inexpensive (compared to ceramic sections) metal support assembly 16 near the cooler flame portion reduces the expense of the combustion section 10.

Figure 2A:
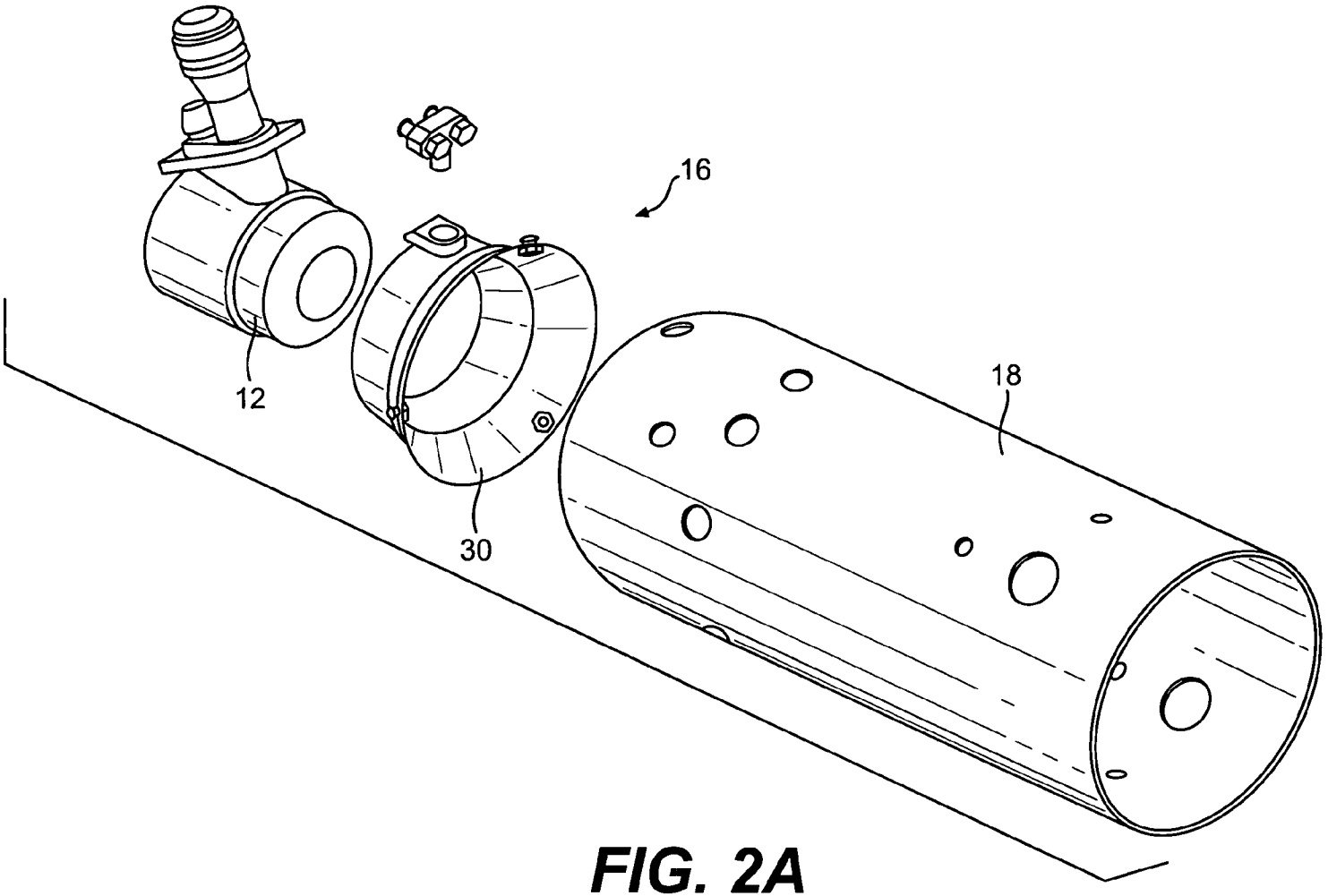
FIG. 2A is an exploded view of a support assembly for a ceramic combustor can.
Figure 2B:
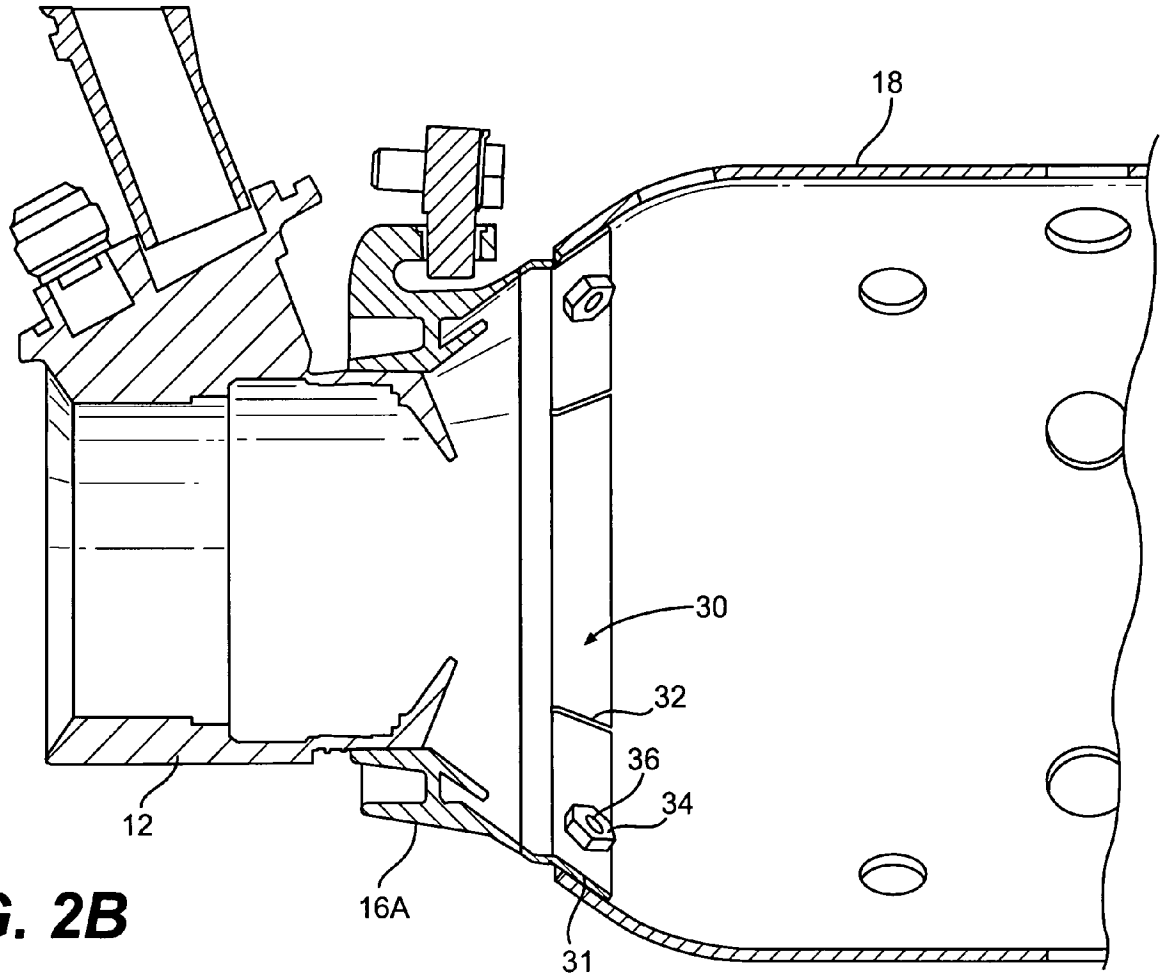
FIG. 2B is a longitudinal sectional view of the combustor section of FIG. 2A in an assembled condition.

Referring to FIG. 2A, a support assembly 16A includes a metal front support ring 30 to interface with the ceramic combustor can 18. Referring to FIG. 2B, due to its CTE, the metal front support ring 30 may grow radially more than the ceramic combustor can 18. An inclined contact interface 31 defined by the front support ring 30 permits the support assembly 16A to slide relative the ceramic combustor can 18 upon thermal excursion. Sliding alleviates thermal growth incompatibility and therefore minimizes thermal stress. A preset gap is preferably provided such that the front support ring 30 can grow thermally free from interfering with the ceramic can 18 and therefore avoid thermally induced stresses. Due to the uncertainty in the precise amount of thermal deformation, some contact between the front support ring 30 and the ceramic combustor can 18 is unavoidable unless a relatively large gap is set between the two. However, too large a gap may be disadvantageous to the support of the ceramic combustor can 18. Therefore a certain degree of compliant contact needs to be provided between the front support ring 30 and the ceramic combustor can 18. This is achieved through a relatively thin wall thickness of the front support ring 30 in combination with slots 32 that truncate hoop stress and thereby reduce hoop stiffness.

A multitude of fasteners 34 provide circumferential and axial constraints between the front support ring 30 and the ceramic combustor can 18. The fasteners 34 are preferably manufactured of high temperature alloys with a center passage 36 (FIG. 2C) to pass cooling air. Fastener openings 38 through the inclined contact interface 31 are preferably at least partially elliptical, slot-like or sized (FIG. 2C) to facilitate relative movement between the front support ring 30 and the ceramic combustor can 18 during thermal excursion.

Figure 2C:
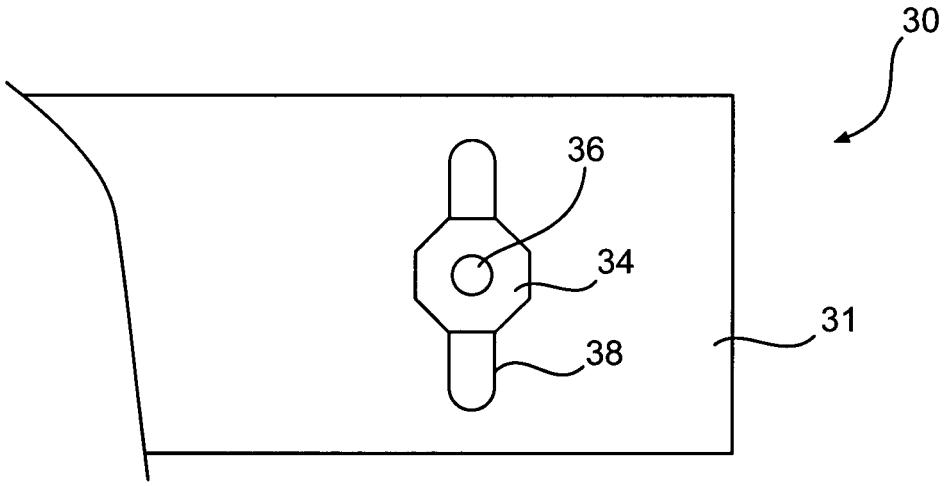
FIG. 2C is a top view of a fastener arrangement for a ceramic combustion can
Figure 3A:
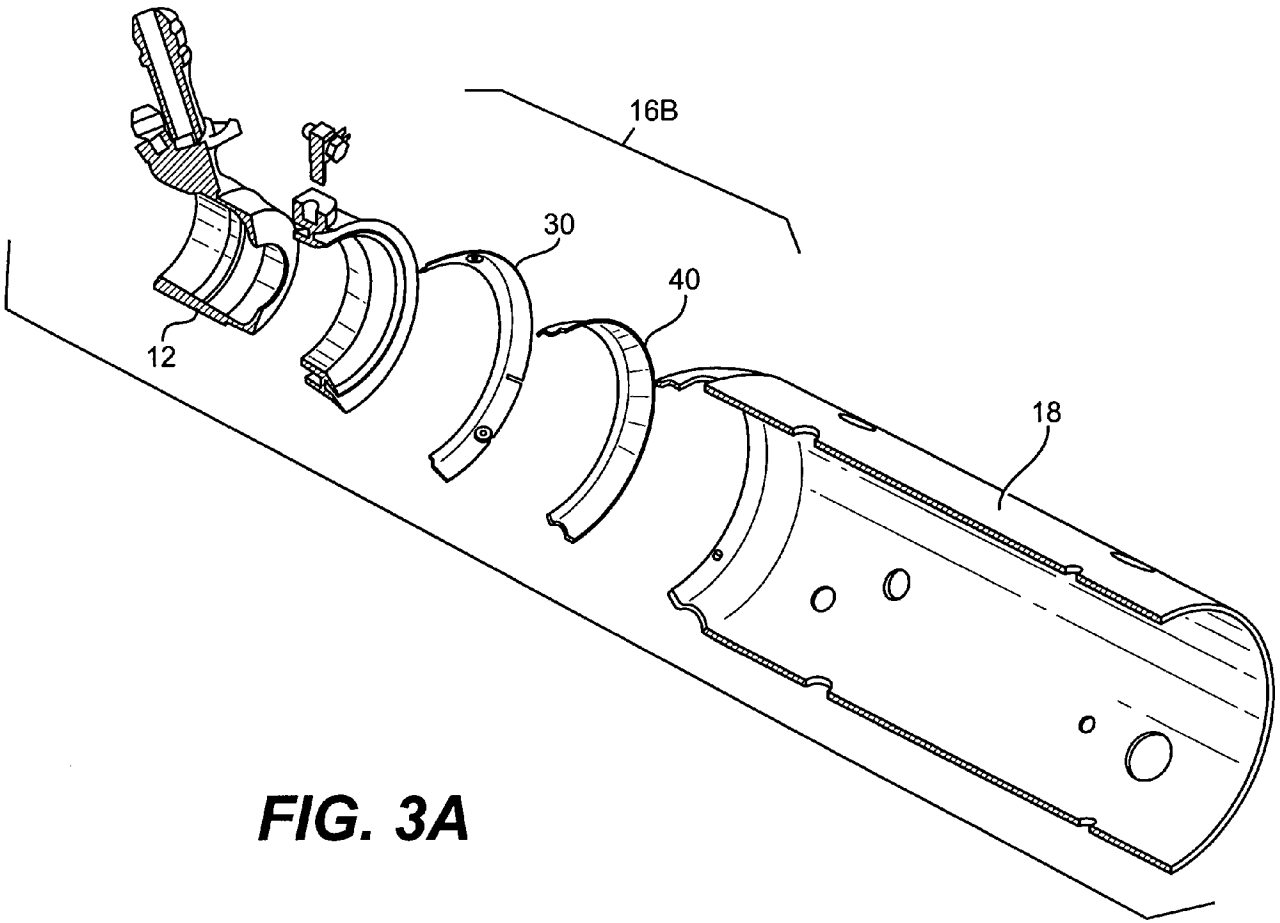
FIG. 3A is an exploded view of another combustion section.

The front support ring 30 of FIGS. 2A-2C is directly exposed to hot combustion gas. Although effective, the integrity of the front support ring 30 may be affected over a prolonged time period since the ceramic combustor can 18 reduces cooling on one side thereof. To provide further integrity, a heat shield 40 is preferably additionally incorporated radially inboard of the metal front support ring 30 (FIG. 3A).

Figure 3B:
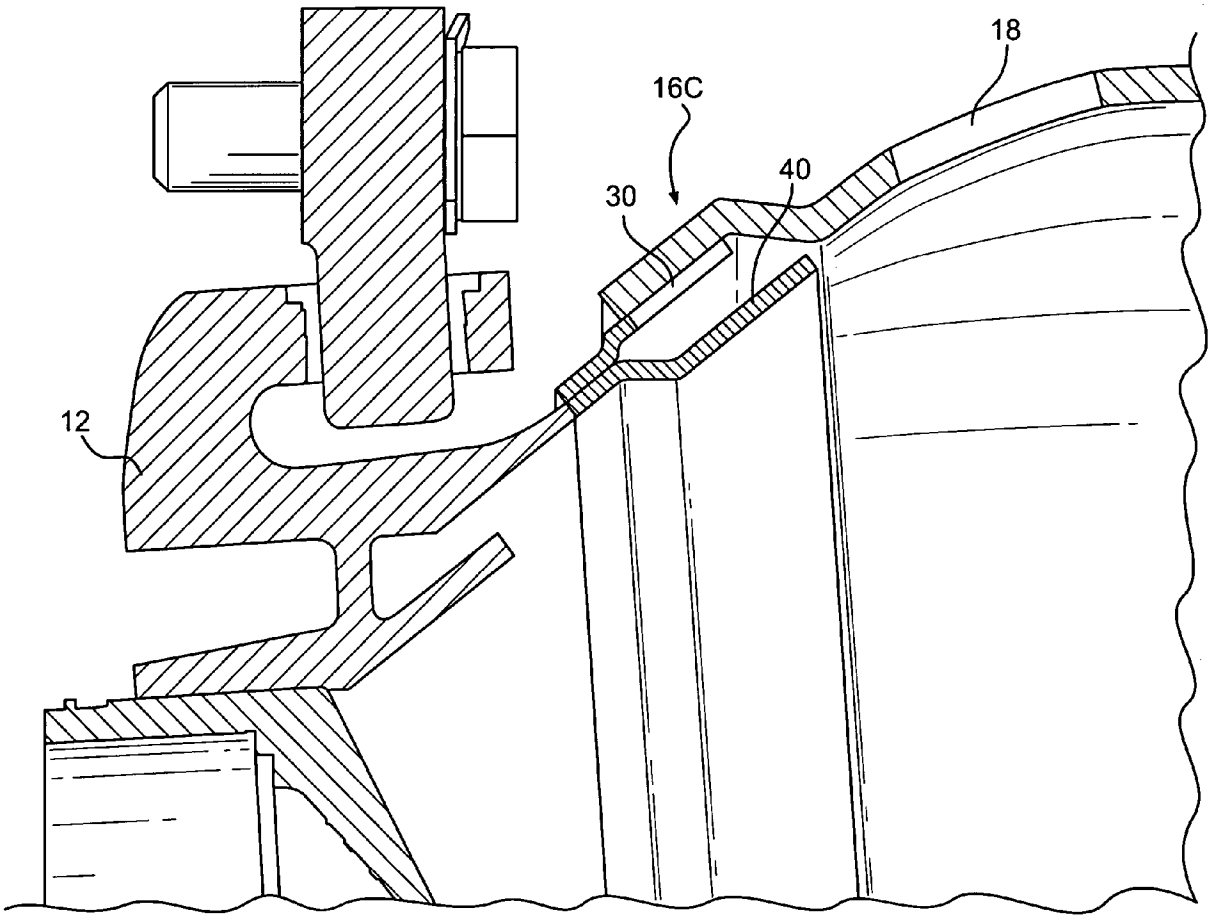
FIG. 3B is an expanded sectional view of the combustion section of FIG. 3A shown in an assembled condition.

Referring to FIG. 3B, another support assembly 16B includes the heat shield 40 which is welded or otherwise mounted to the front support ring 30. The heat shield 40 is actively cooled by impingement cooling air on the outer diameter thereof. As the front support ring 30 now operates in a relatively lower temperature regime since it is protected by the heat shield 40, front support ring 30 will withstand higher stresses.

Figure 4A:
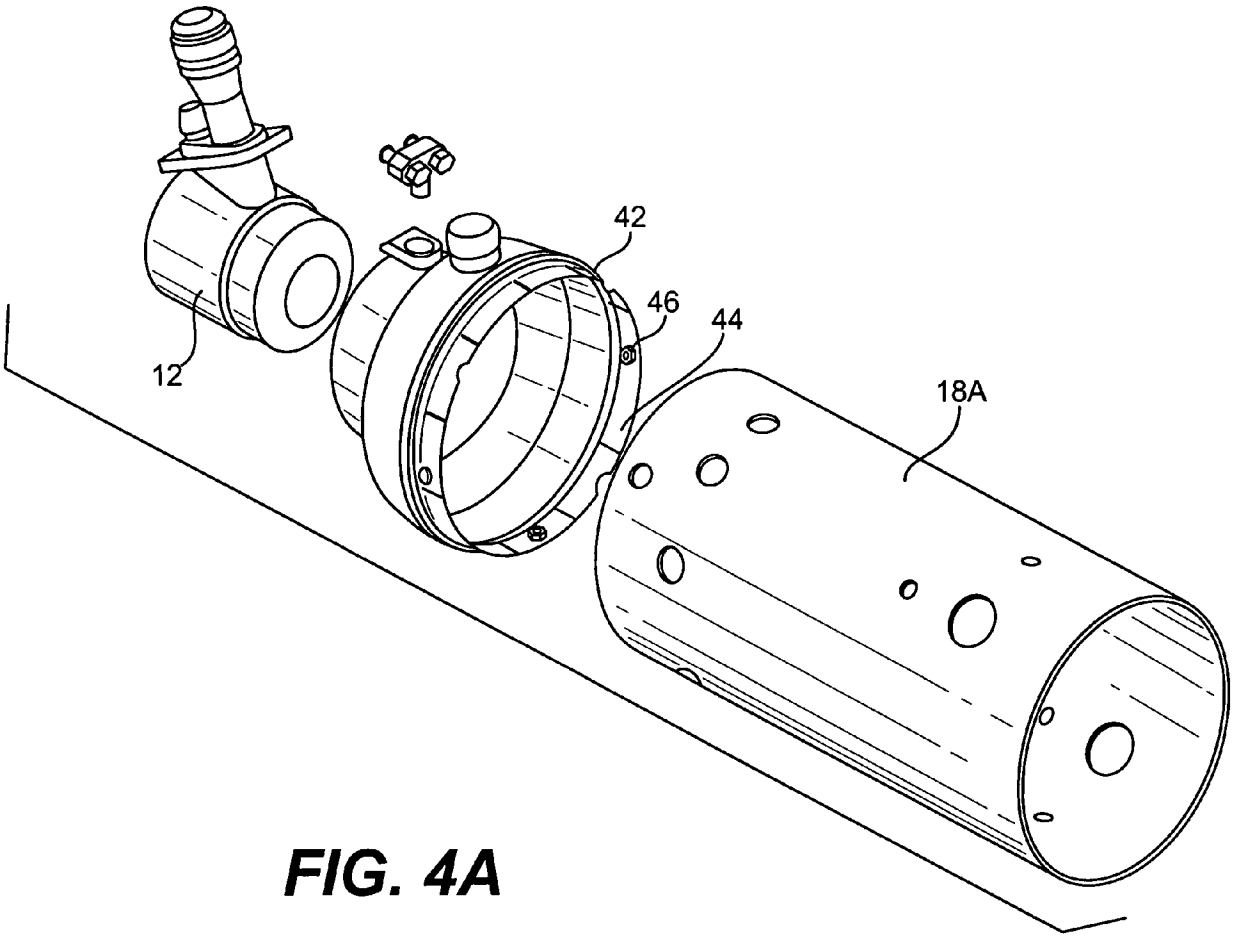
FIG. 4A is an exploded view of another combustion section.
Figure 4B:
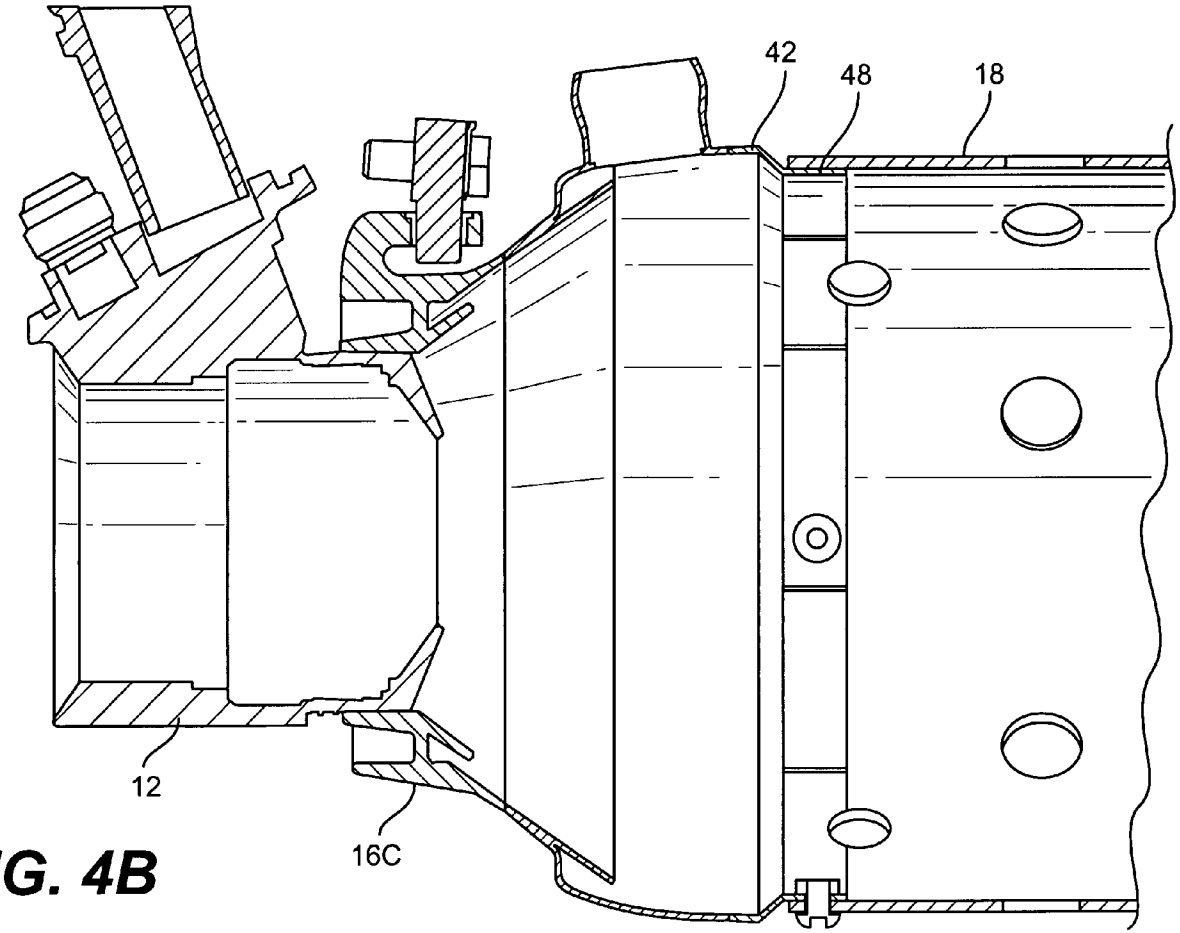
FIG. 4B is an expanded sectional view of the combustion section of FIG. 4A shown in an assembled condition

Referring to FIGS. 4A and 4B, it is generally advantageous to have a relatively simplified geometry for ceramic components while incorporating the necessary design complexities into metal components. Here, the ceramic combustor can 18A is manufactured as a relatively straight cylinder. A support assembly 16C includes an axially extended front support ring 42 which extends downstream to support the ceramic combustor can. Although not providing the inclined interface surface discussed above, a gap relative the ceramic combustor can 18A, the relatively thin material, a multitude of slots 44, and the elongated fastener opening 46 as also described above sufficiently accommodates thermal stress. Preferably, the extended front support ring 42 includes a reduced diameter stepped interface 48 (FIG. 4B) over which the ceramic combustor can 18A is received.

Figure 5A:
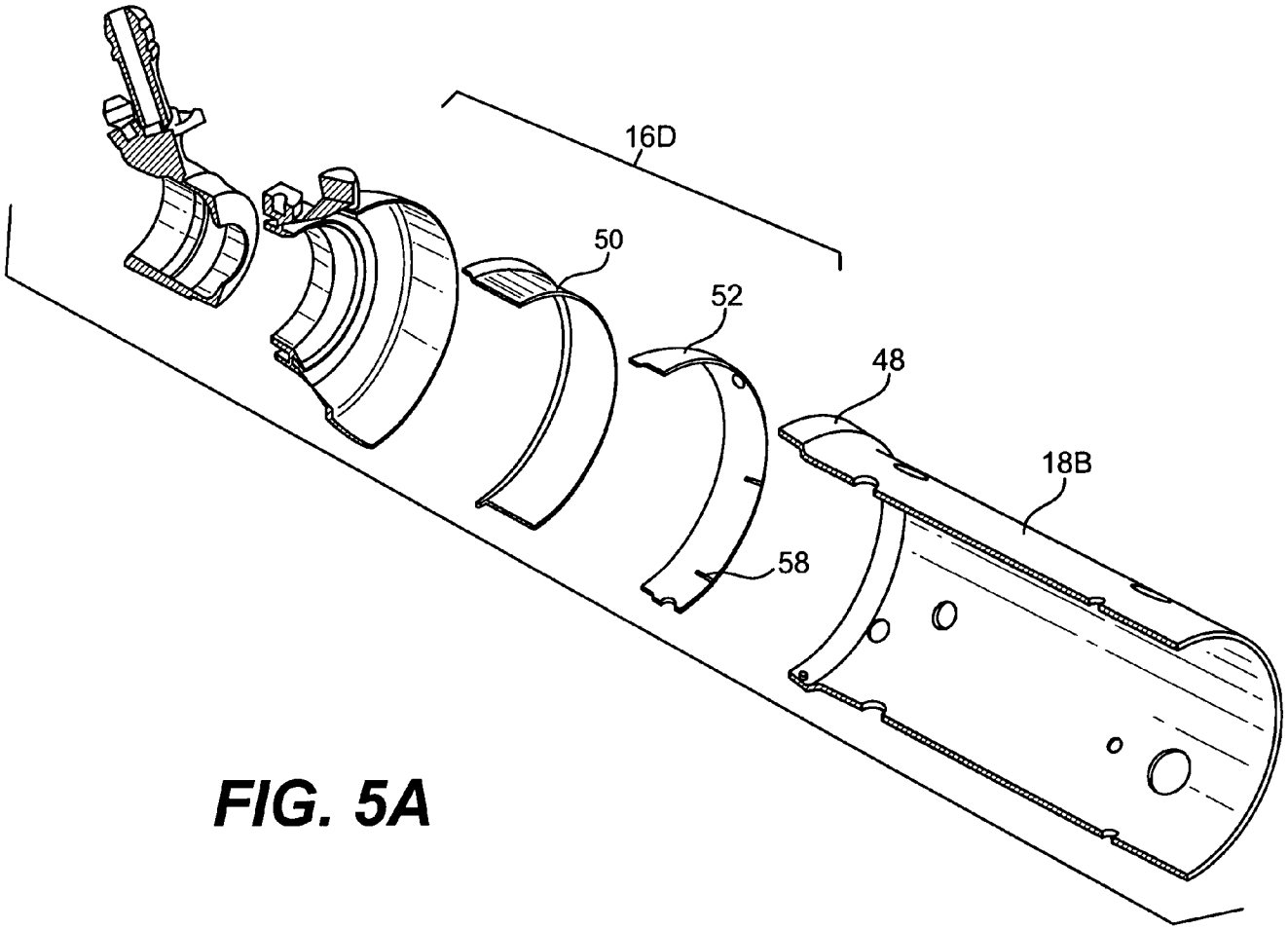
FIG. 5A is an exploded view of another combustion section.
Figure 5B:
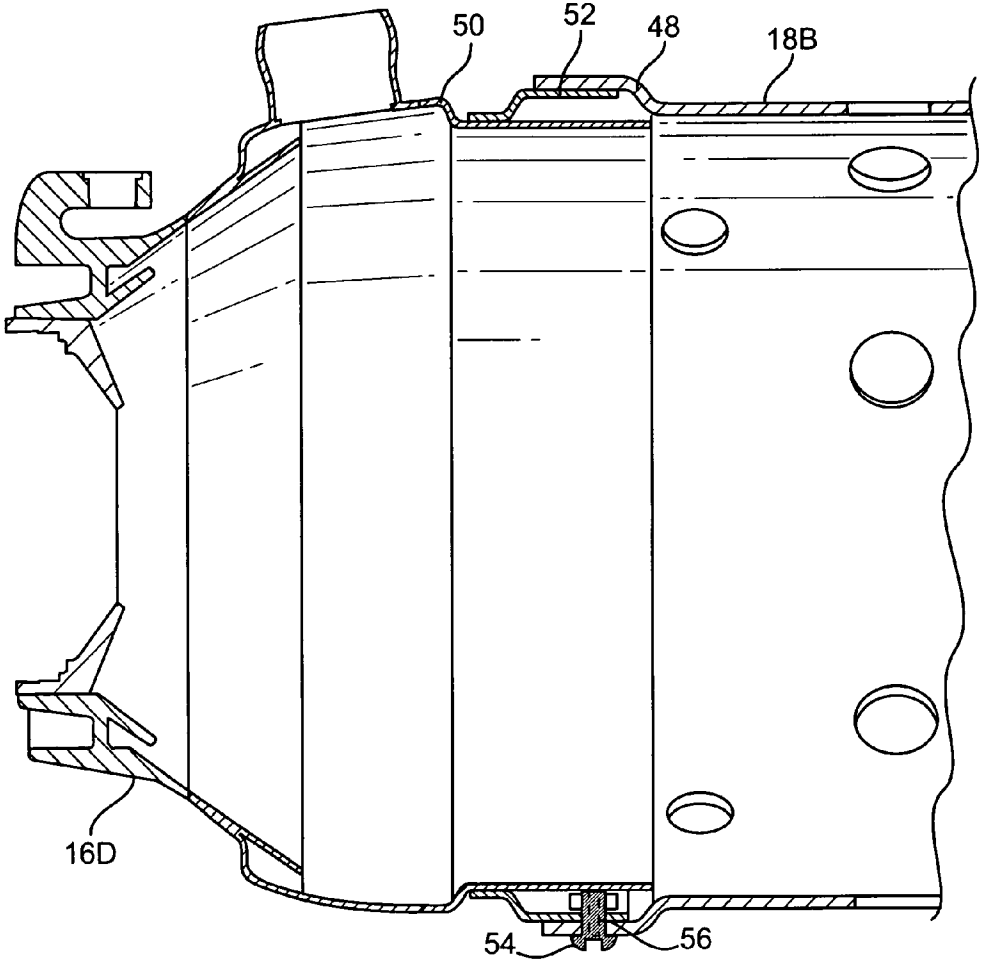
FIG. 5B is an expanded sectional view of the combustion section of FIG. 5A shown in an assembled condition.

Referring to FIGS. 5A and 5B, a ceramic combustor can 18B includes an outwardly flared attachment segment 48 to receive an extended heat shield 50 and an attached front support ring 52 (FIG. 5B) of a support assembly 16D. The front support ring 52 preferably includes slots 58 as described above to truncate hoop stresses. The extended heat shield 50 is preferably welded or otherwise affixed to the front support ring 52 to form a radial spring interface with the outwardly flared attachment segment 48. That is, the attached front support ring 52 is essentially radially interference fit into the outwardly flared attachment segment 48 and axially retained therein by a multitude of fasteners 54 which may be mounted through elongated openings 56. Thermal expansion is thereby readily accommodated.

Figure 6A:
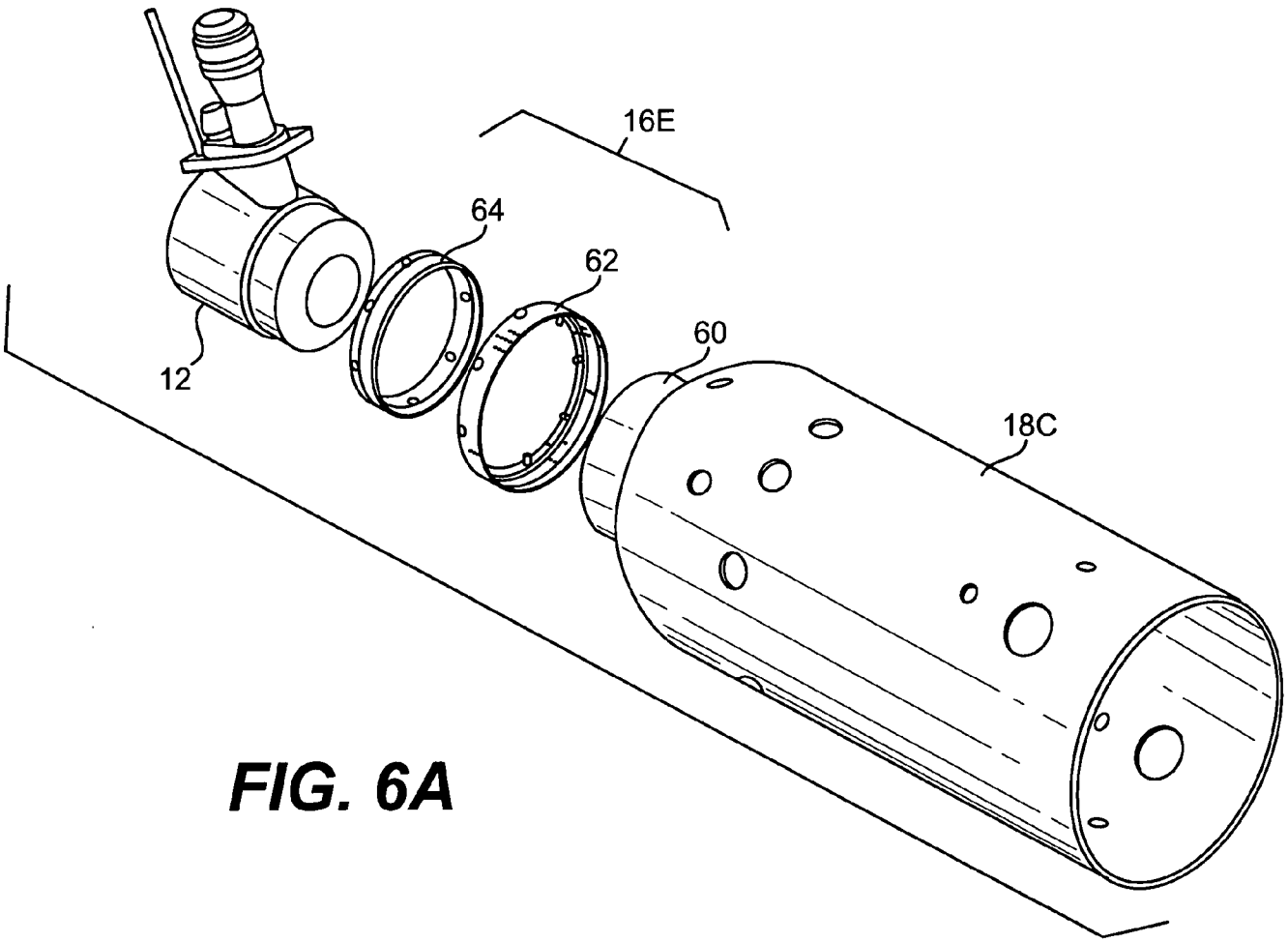
FIG. 6A is an exploded view of another combustion section.

Referring to FIG. 6A, a ceramic combustor can 18C with a reduced diameter attachment segment 60 provides a bottle-shaped ceramic combustor can 18C. In combustors where the majority of the combustion process takes place close to the fuel air mixer 12, a significant amount of CO is generated at the forward portion of the combustor and subsequently quenched. For these combustors, it is desirable to minimize film cooling in this area of the combustor or for the entire length of the combustor can 18C. One attribute of this design is that the attachment segment 60 is in a relatively low temperature part of the combustor, which enables thermal stress management by minimizing the overall thermal growth.

Figure 6B:
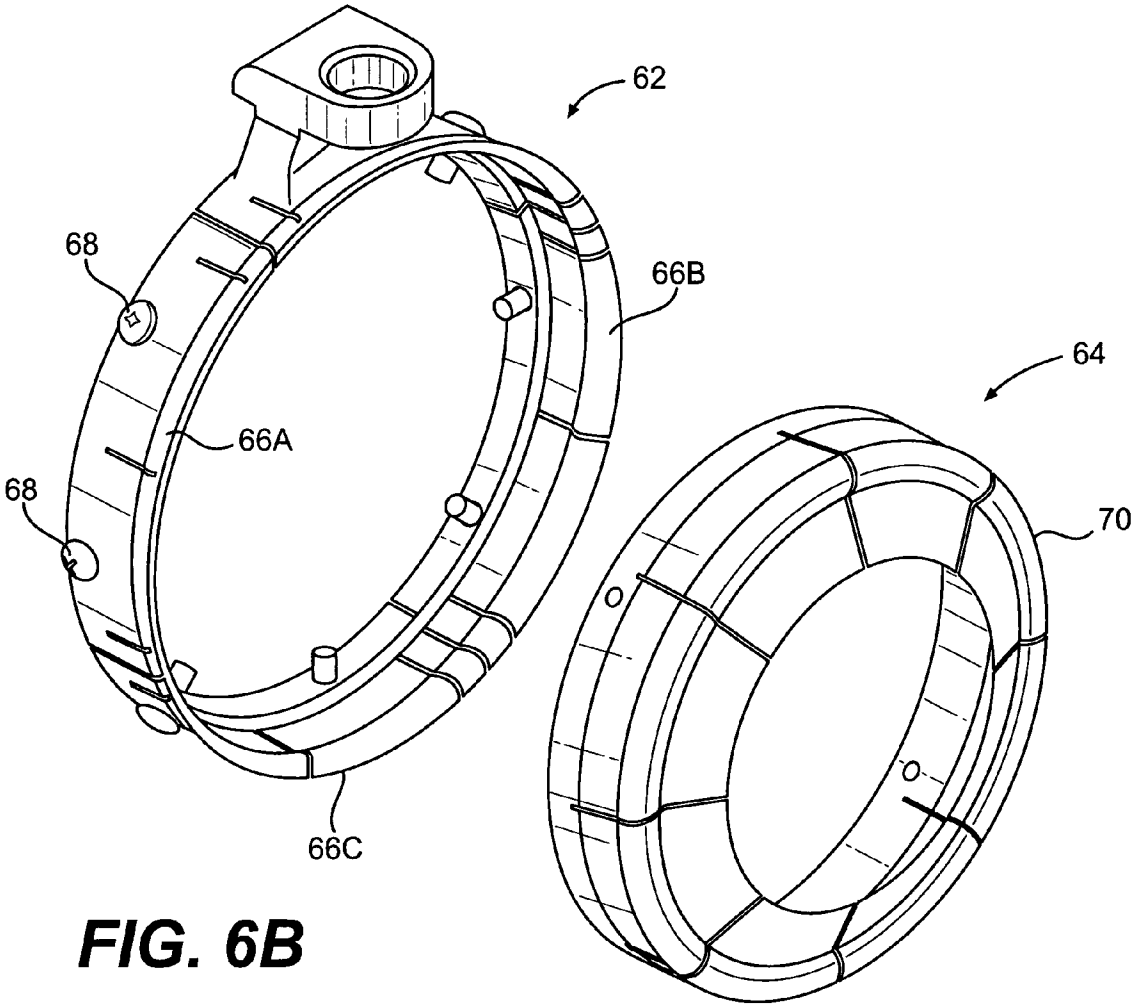
FIG. 6B is an expanded perspective view of the support assembly illustrated in FIG. 6A.
Figure 6C:
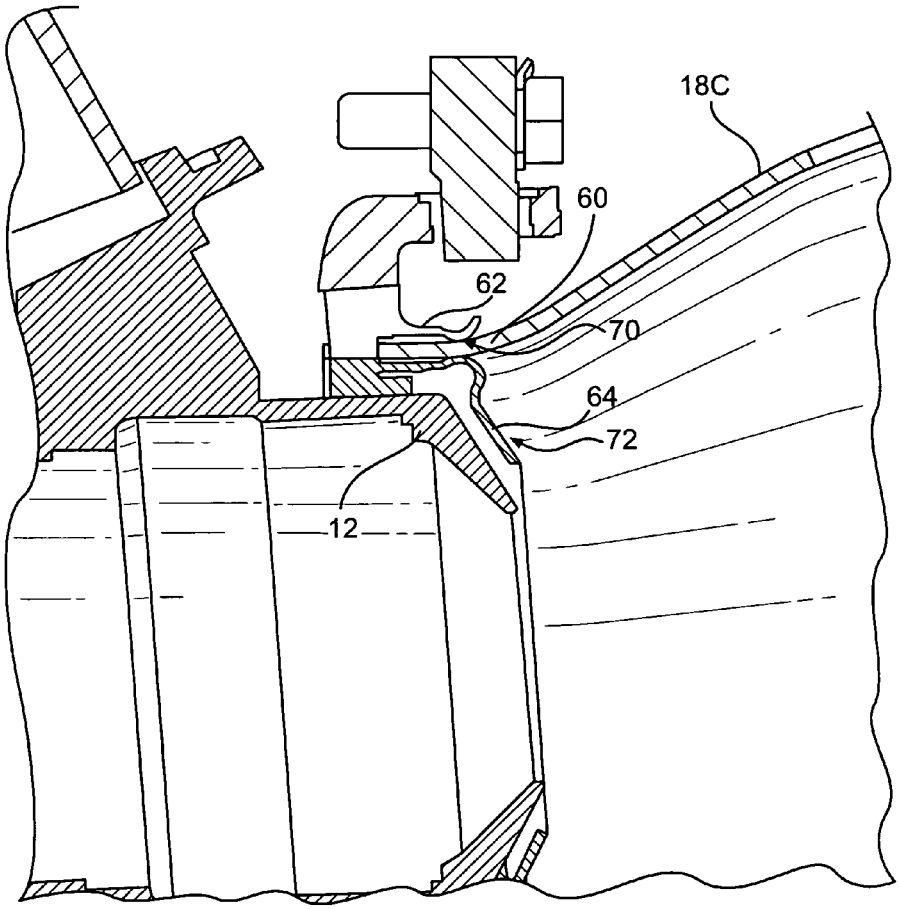
FIG. 6C is an expanded sectional view of the combustion section of FIG. 6A shown in an assembled condition.

The ceramic combustor can 18C attachment segment 60 is sandwiched between an outer-segmented ring 62 and an inner full ring 64 (FIG. 6C). Thermal stress is received primarily through the complaint inner full ring 64 and the separated sections 66 of the outer-segmented ring 62. The outer segmented ring 62, may be formed into a multiple of segments (three shown 66A, 66B, 66C, each with two fasteners 68; FIG. 6B). The segmentation and the fasteners per segment permit the outer segmented ring 62 to follow the thermal growth of the ceramic combustor can 18C without significant stress.

The inner full ring 64 preferably includes a ridge 70 which seals to the ceramic combustor can 18C in an interference manner irrespective of relative thermal distortion (FIG. 6C). Another attribute is that the inner full ring 64 includes a frustro-conical surface 72 that defines a cooling path about the fuel air mixer 12.

Figure 7A:
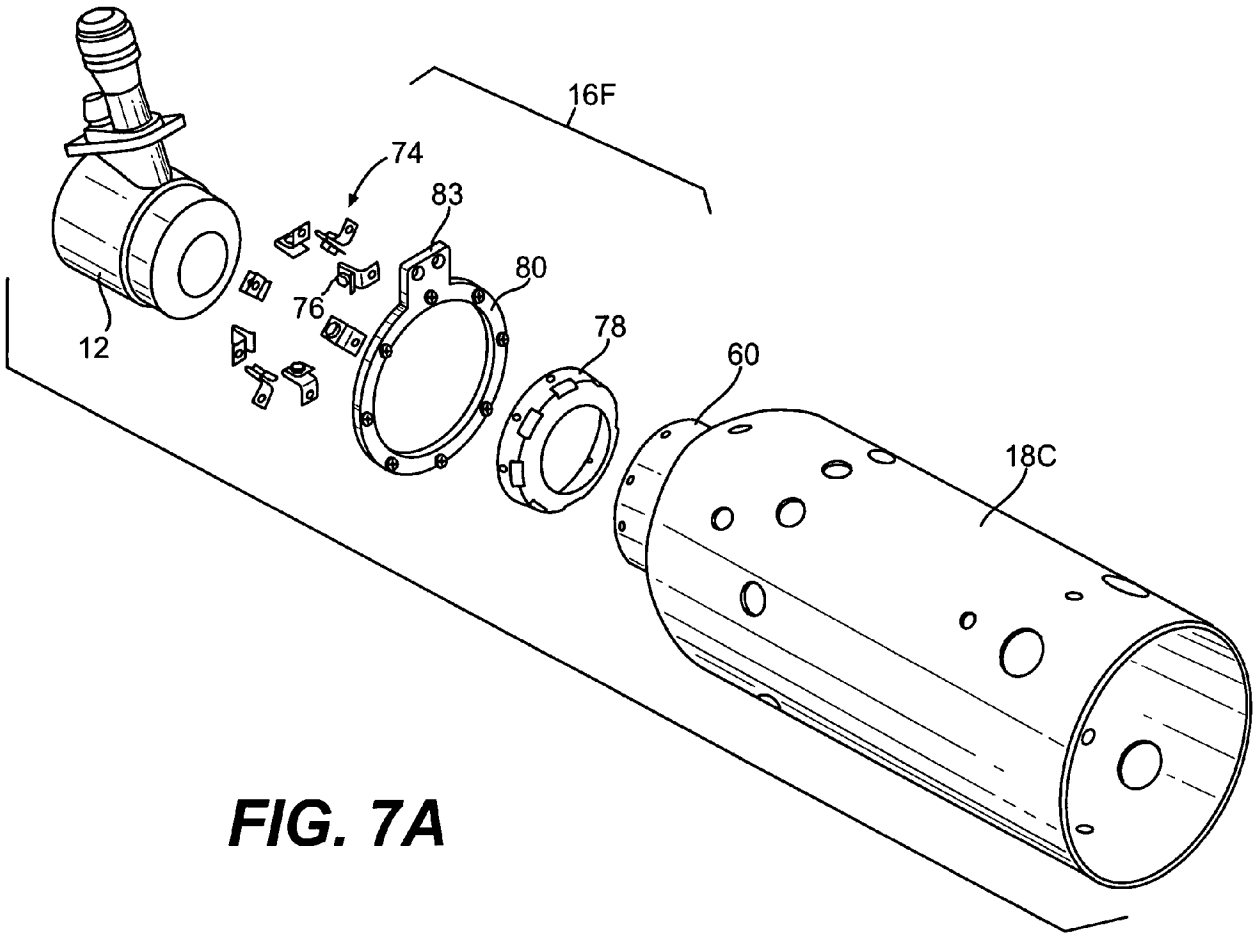
FIG. 7A is an exploded view of another combustion section.
Figure 7B:
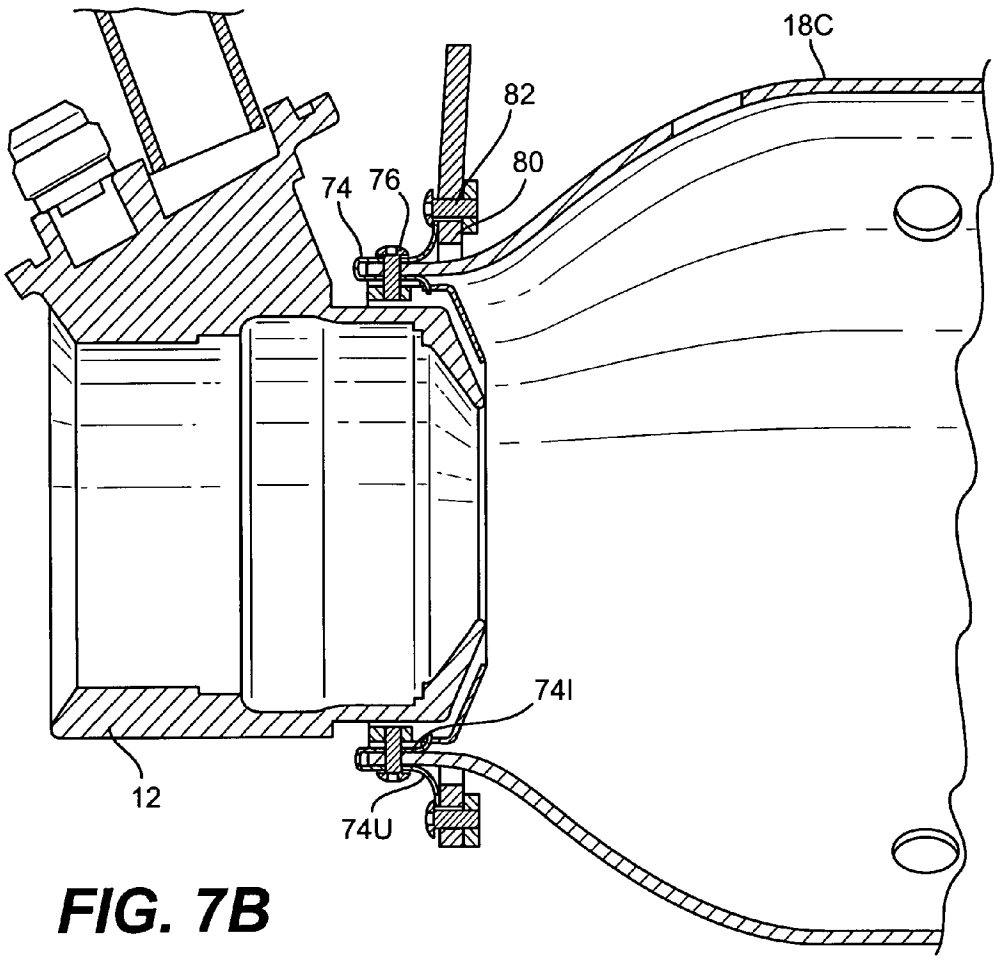
FIG. 7B is an expanded sectional view of the combustion section of FIG. 3A shown in an assembled condition.
Figure 7C:
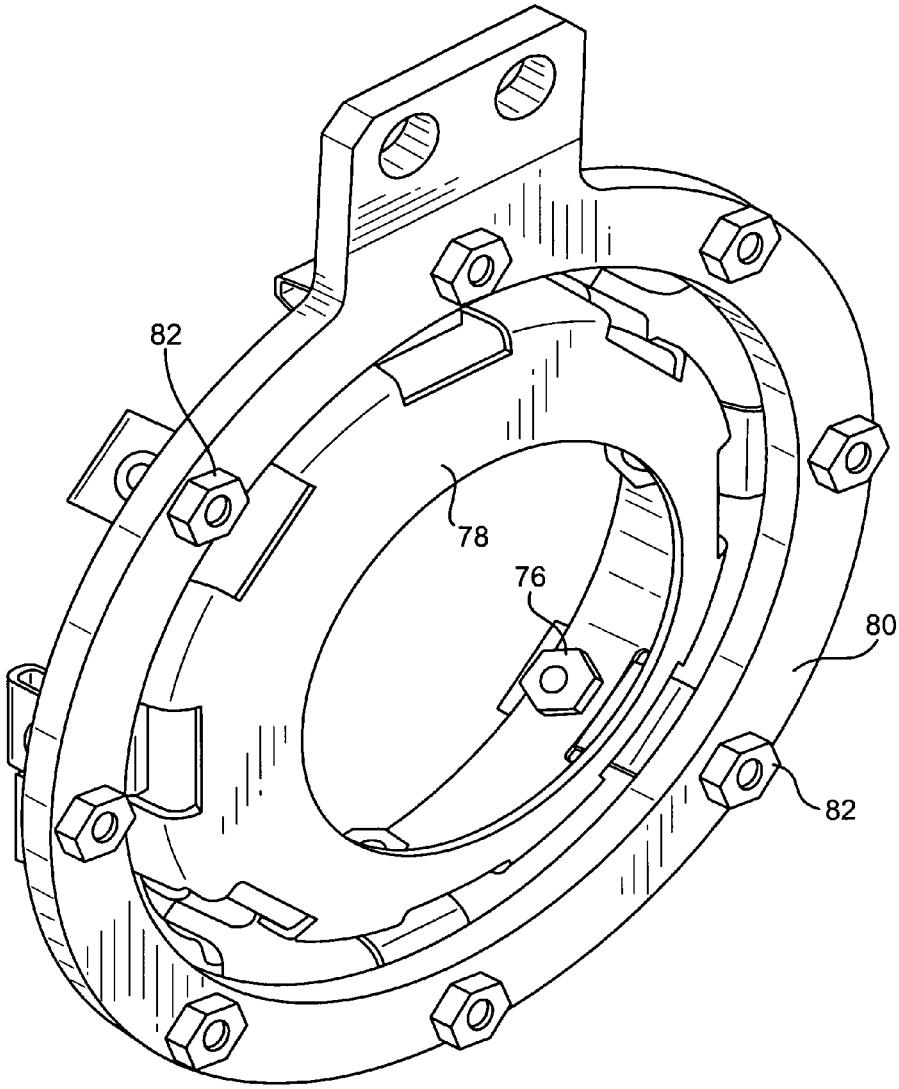
FIG. 7C is an expanded perspective view of the support assembly illustrated in FIG. 7A
Figure 7D:
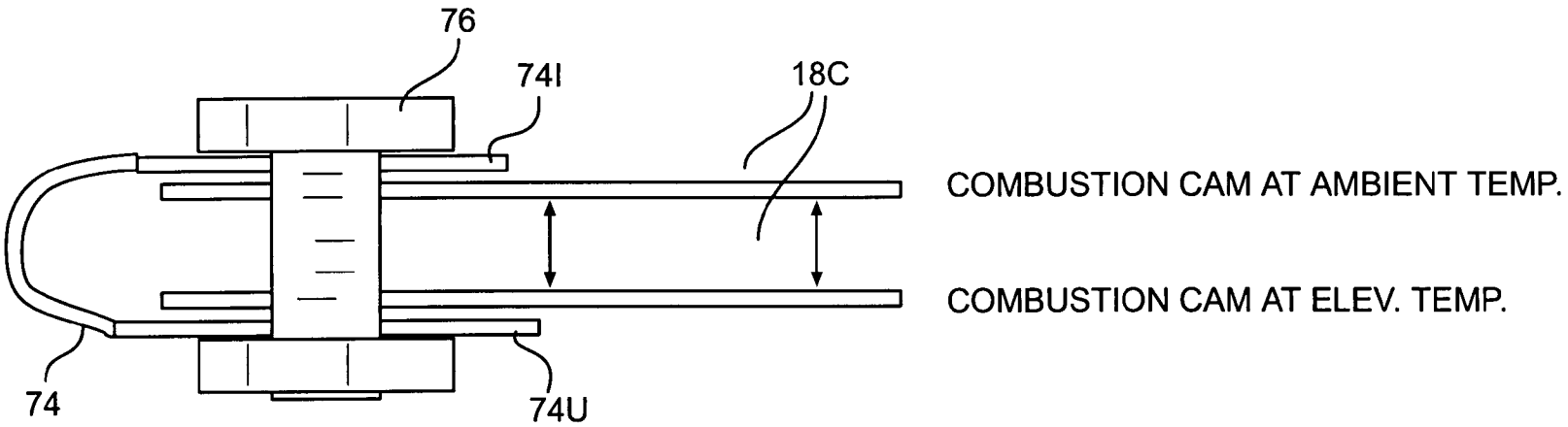
FIG. 7D is an expanded schematic view of the fastener arrangement illustrated in FIG. 7A showing combustor can thermal excursion and the accommodation thereof.

Referring to FIG. 7A, a multitude of retainers 74, preferably formed of "U" shaped metal strips that receive a front lip of the ceramic combustor can 18C between an inner support 78 and an outer support plate 80. A fastener 76 through each retainer 74 "locks" the ceramic combustor can 18C axially and circumferentially, while the retainers 74 provide radial support (FIGS. 7B and 7C). To reduce thermal stress, a gap is preferably formed between a radially inboard leg 741 of the retainer 74 and the ceramic combustor can 18C. In such a configuration, the OD of the ceramic combustor can 18C is piloted on the ID of each radially outboard leg 74U of the retainer 74. Both legs 741, 74U behave like a beam upon loading and as such they deform substantially without inducing high stresses to accommodate temperature excursion of the ceramic combustor can 18C (FIG. 7D). The retainers 74 are attached to the outer support plate 80 by the fasteners 82 (FIG. 7C). The outer support plate 80 may preferably include an extension 83 which facilitates attachment to the combustor outer casing 20 and inner casing 22 (FIG. 1).

Figure 8A:
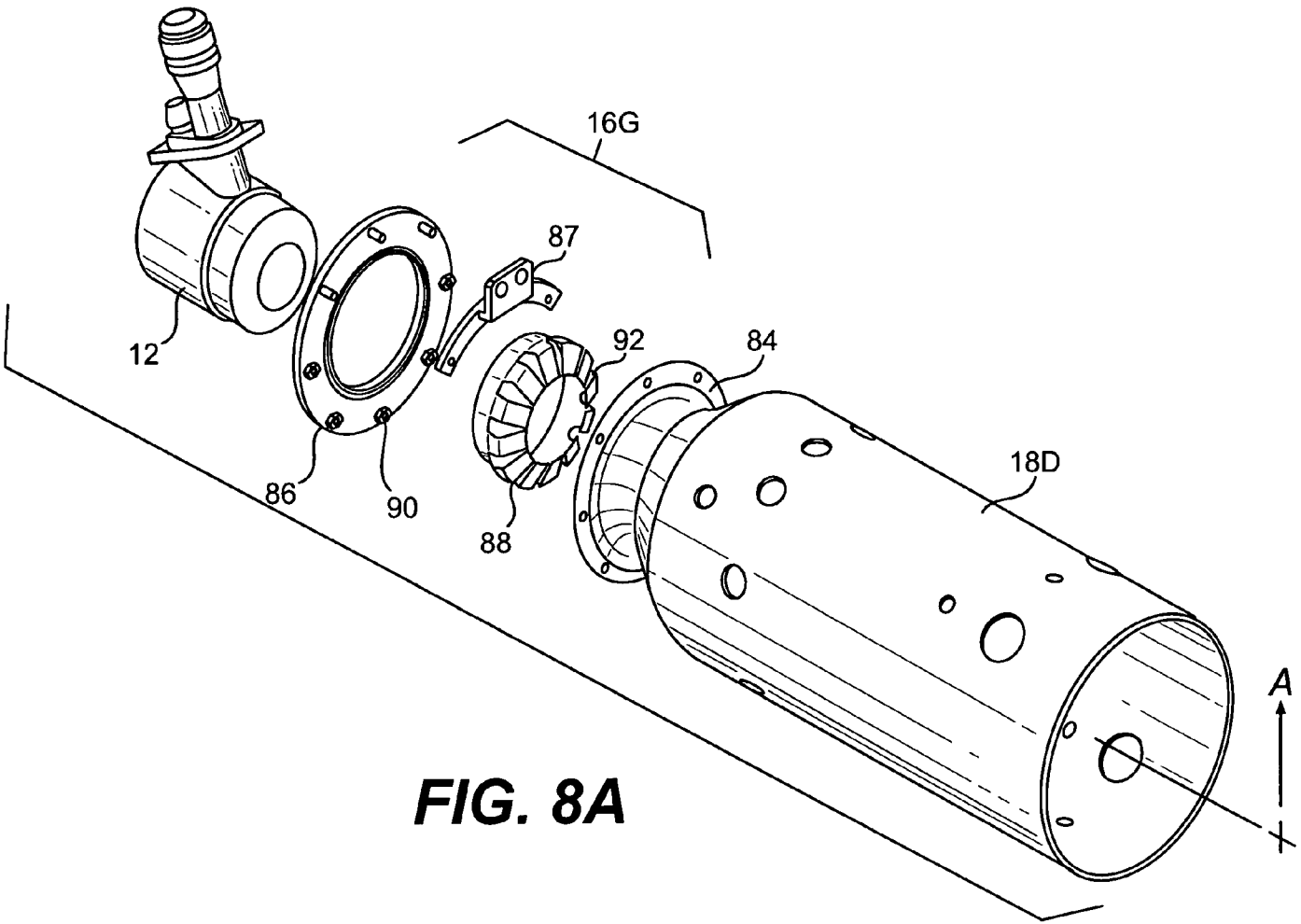
FIG. 8A is an exploded view of another combustion section.

Referring to FIG. 8A, thermal growth mismatch is confined within a plane normal to a longitudinal axis A of the ceramic combustor can 18D. The ceramic combustor can 18D includes a formed radial flange 84. Although relatively more complicated to manufacture, the ceramic combustor can 18D facilitates an uncomplicated interface with the air fuel mixer 12. As such, radial thermal growth incompatibility need only be resolved within a plane that contains the radial flange 84.

Figure 8B:
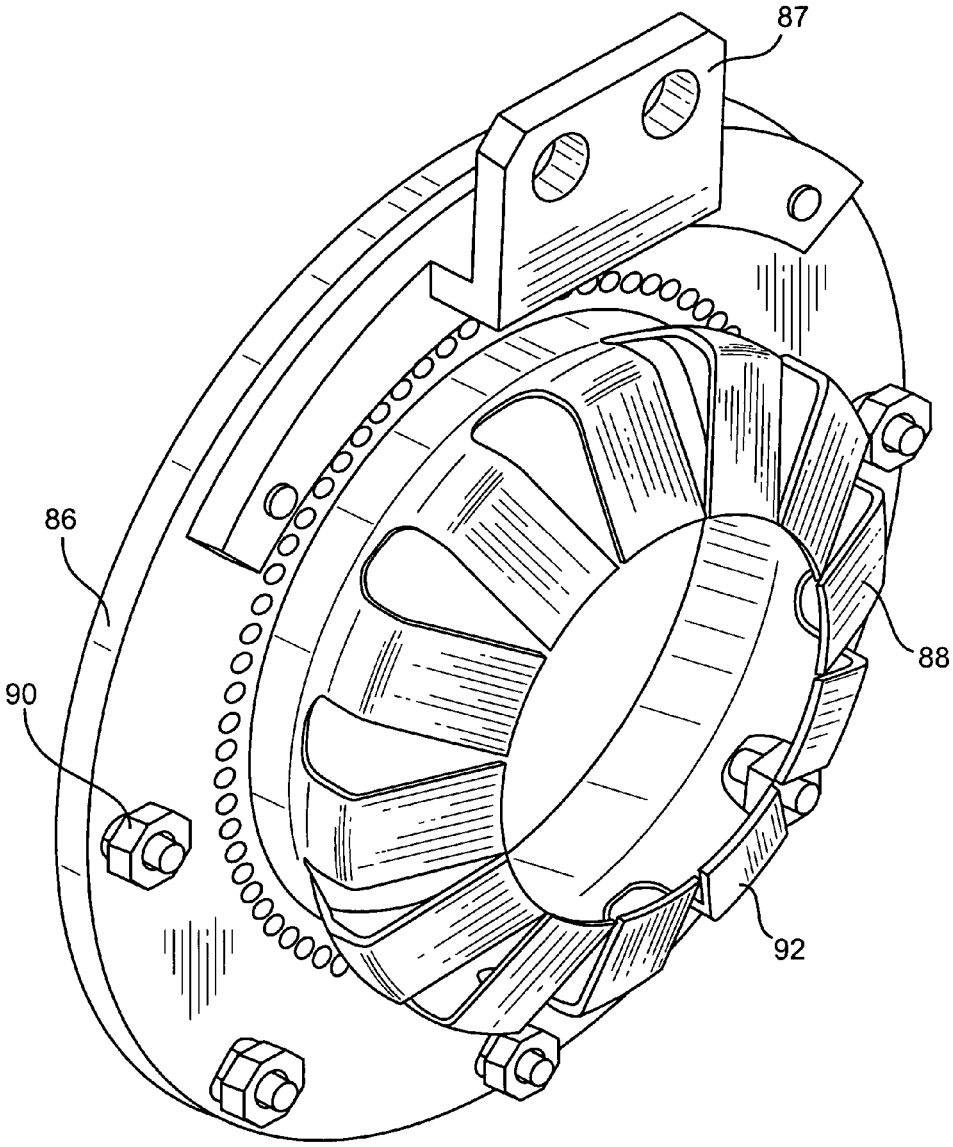
FIG. 8B is an expanded perspective view of a support assembly of FIG. 8A shown in an assembled condition.
Figure 8C:
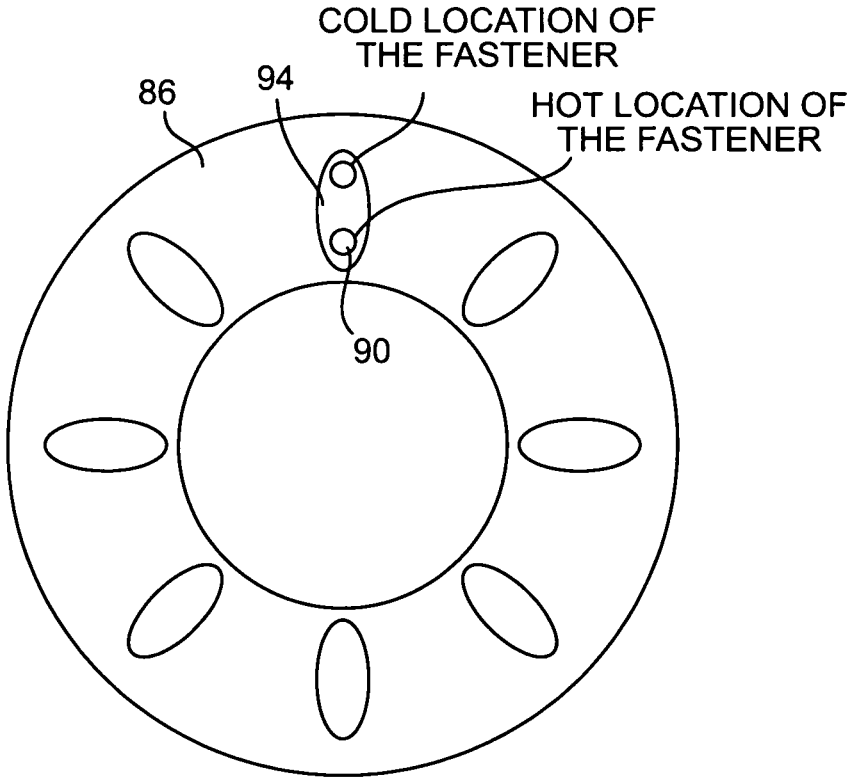
FIG. 8C is a schematic face view of a support plate illustrating movement of a fastener due to thermal excursion of the combustor can relative the support assembly.

A support assembly 16G includes a metal support plate 86, a metal inner support 88, an attachment member 87 and a multitude of fasteners 90 (FIG. 8B). The metal inner support 88 includes a multiple of fingers 92 which generally operate as a spring to provide an interference fit with the ceramic combustor can 18D. The support plate 86 includes a multiple of elongated fastener opening 94 (FIG. 8C). The openings 94 are sized in such a way that after assembly and at room temperature, the fasteners 90 are located at the radially outer positions (FIG. 8C). At engine operating conditions, the metal support plate 86 grows more than the ceramic combustor can 18D and the fasteners 90 are located at radial inward positions of the openings 94.

Figure 8D:
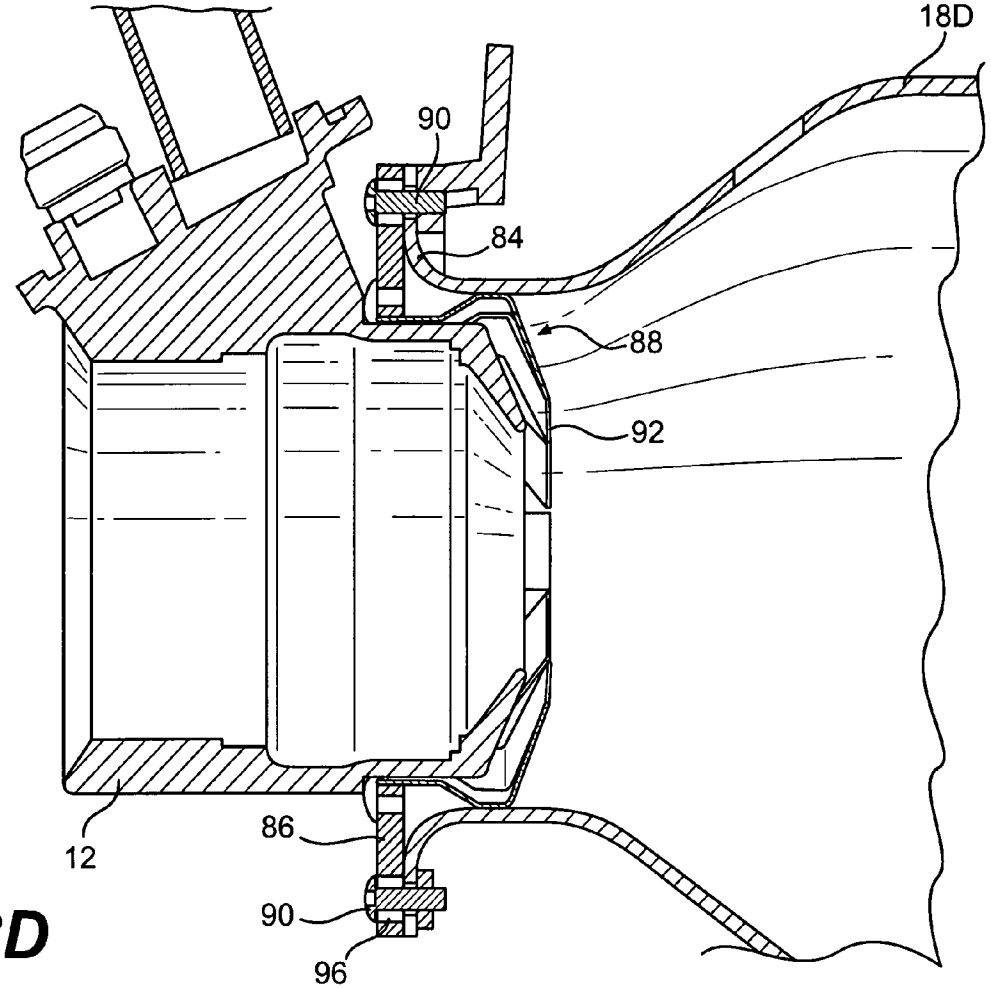
FIG. 8D is a longitudinal sectional view of the combustion section of FIG. 8A illustrated in an assembled condition.

Referring to FIG. 8D, the ceramic combustor can 18D is clamped to the stiff metal support plate 86 with the fasteners 90 and an associated spring washer 96 such as Bellville washers. The fingers 92 maintain the a retention load during cold to hot thermal excursions to provide a friction force that permits the metal support plate 86 to slide relative the ceramic combustor can 18D while the spring washers 96 maintain tension on the fasteners 90 during radial movement.

Figure 9A:
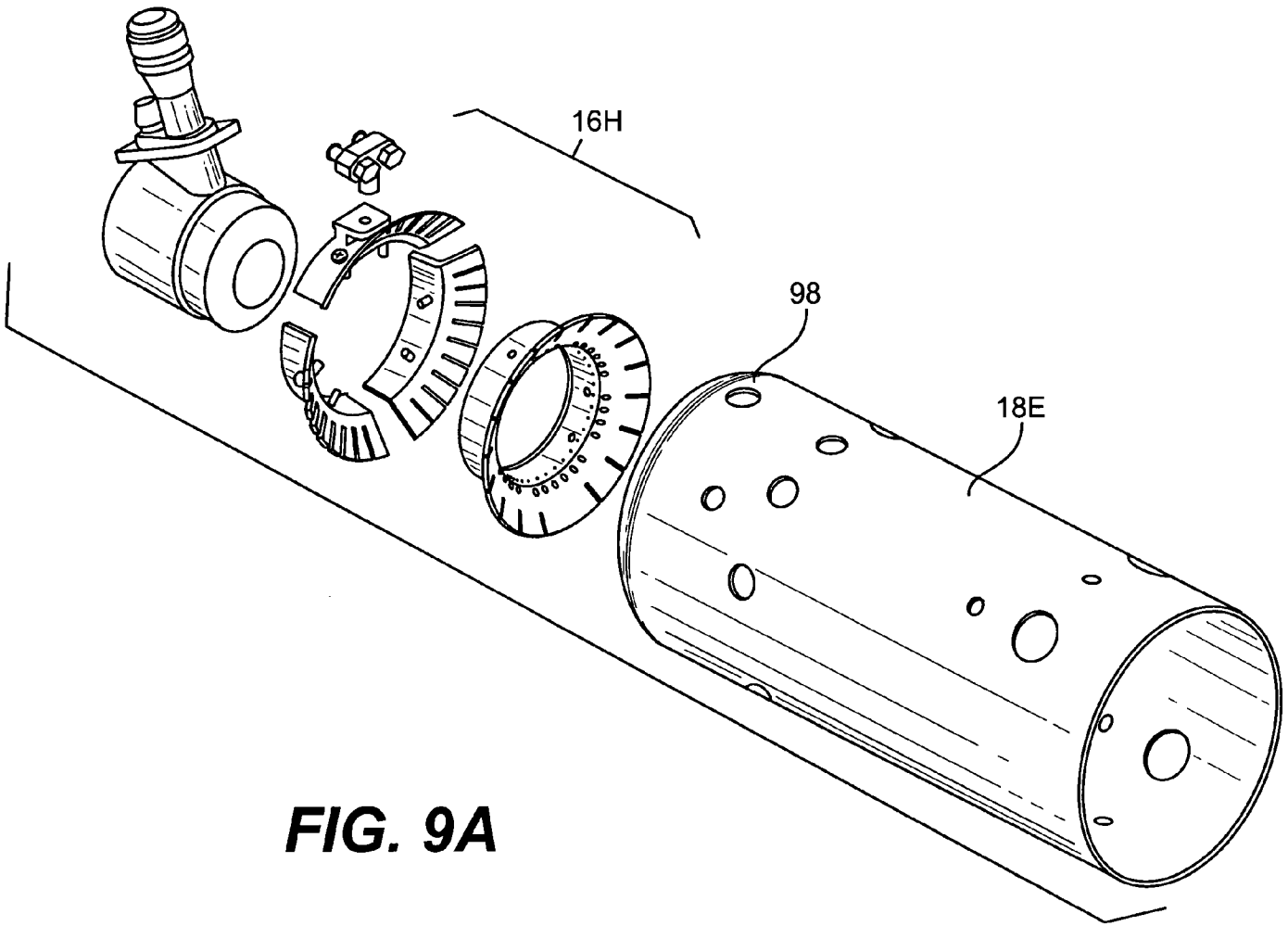
FIG. 9A is an exploded view of another combustion section.
Figure 9B:
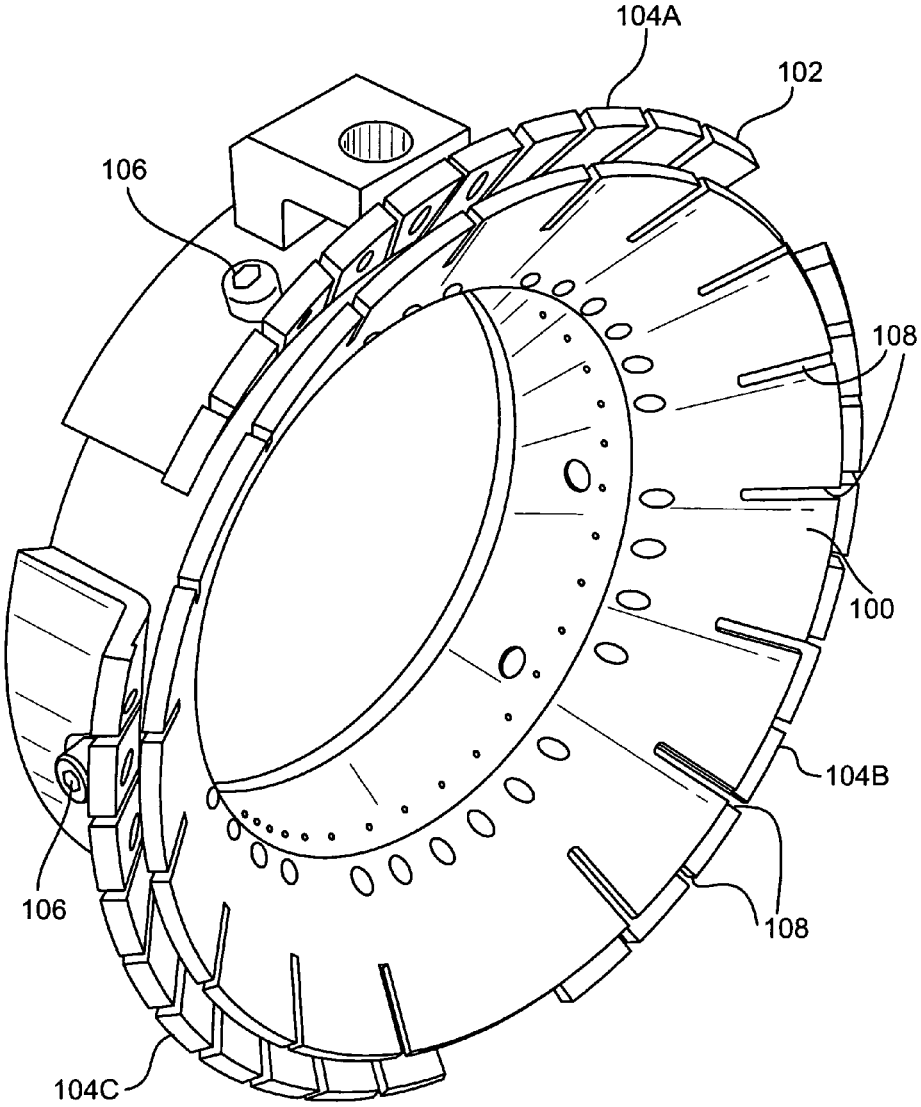
FIG. 9B is an expanded perspective view of the support assembly illustrated in FIG. 9A.
Figure 9C:
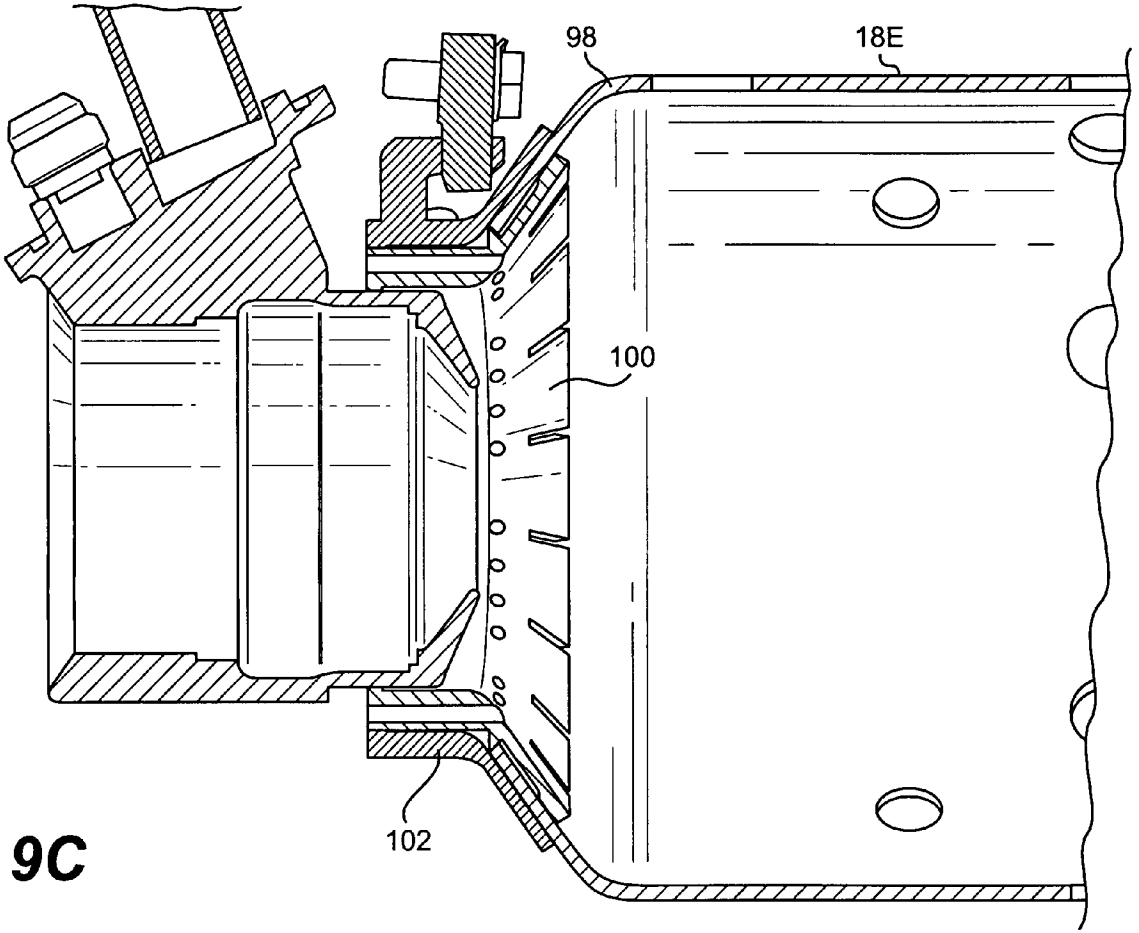
FIG. 9C is an expanded sectional view of the combustion section of FIG. 9A shown in an assembled condition.

Referring to FIG. 9A, a ceramic combustor can 18E is manufactured as a relatively straight cylinder with a frustro-conical attachment segment 98 which is preferably of an approximately 45 degree slope. The frustro-conical attachment segment 98 facilitates sliding of the ceramic combustor can 18E between an inner frustro-conical support 100 and a segmented outer frustro-conical support 102 (FIG. 9B). The segmented outer frustro-conical support 102 may be formed into a multiple of segments (three shown 104A, 104B, 104C; each with two fasteners 106). The segmentation and the fasteners per segment permit the segmented outer frustro-conical support 102 to follow the thermal growth of the ceramic combustor can 18D without significant stress during temperature transient and therefore reduces thermal stress buildup as afore mentioned. A multiple of slots 106, 108 in each of the inner frustro-conical support 100 and a segmented outer frustro-conical support 102 operate in accordance with that described above. It should be understood that the inner frustro-conical support 100 is received within the ceramic combustor can 18D from the end opposite the frustro-conical attachment segment 98 such that fasteners 108 in the segmented outer frustro-conical support 102 are received therein so as to clamp the ceramic combustor can 18D therebetween (FIG. 9C).

Although a ceramic combustor can has been described, the proposed attachment methods are equally applicable for joining two components made of different 'CTE materials.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

We claim:

1. A combustor section comprising:

a support assembly having a first Coefficient Thermal Expansion (CTE), said support assembly including a front support ring extending around an axis;

a fuel air mixer mounted to a forward axial side of the support assembly; and a non-metallic combustor can having a second Coefficient Thermal Expansion (CTE) different than said first Coefficient Thermal Expansion (CTE), said combustor can mounted to an opposite, aft axial side of said support assembly, said front support ring being fastened with a multitude of fasteners, which engage said front support ring and said combustor can, to an inner diameter of said non-metallic combustor can at an inclined contact interface defined by said front support ring and said non-metallic combustor can.

2. The combustor section as recited in claim 1, wherein said inclined contact interface permits said support assembly to slide relative said non-metallic combustor can.

3. The combustor section as recited in claim 1, wherein said front support ring defines a relatively thin wall thickness at said contact interface.

4. The combustor section as recited in claim 1, wherein said contact interface has a certain degree of compliant contact between said front support ring and said inner diameter of said non-metallic combustor can.

5. The combustor section as recited in claim 1, wherein said front support ring defines a relatively thin wall thickness at said contact interface to provide a certain degree of compliant contact between said front support ring and said inner diameter of said non-metallic combustor can.

6. The combustor section as recited in claim 1, wherein said combustor can is a cylindrical member.

7. The combustor section as recited in claim 1, wherein said inclined contact interface inclines toward a center of said non-metallic combustor can.

8. The combustor section as recited in claim 1, wherein said inclined contact interface is annular and inclines toward a center of said non-metallic combustor can.

9. The combustor section as recited in claim 1, wherein said front support ring includes a multitude of axially elongated fastener openings through which, respectively, said multitude of fasteners extend.

10. The combustor section as recited in claim 1, further comprising a multitude of slots circumferentially spaced around said front support ring.

11. The combustor section as recited in claim 1, wherein said front support ring extends radially outwardly from a remaining portion of said support assembly and said non-metallic combustor can extends radially inwardly from a remaining portion of said non-metallic combustor can at said inclined contact interface.

12. The combustor section as recited in claim 1, wherein said fuel air mixer includes a cylindrical connector portion.

13. The combustor section as recited in claim 12, wherein said connector portion mates with a corresponding cylindrical portion extending from said front support ring.

* * * * *